US009741311B2

(12) United States Patent
Morita

(10) Patent No.: US 9,741,311 B2
(45) Date of Patent: Aug. 22, 2017

(54) DATA LINE DRIVER, SEMICONDUCTOR INTEGRATED CIRCUIT DEVICE, AND ELECTRONIC APPLIANCE WITH IMPROVED GRADATION VOLTAGE

(71) Applicant: SEIKO EPSON CORPORATION, Tokyo (JP)

(72) Inventor: Akira Morita, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 237 days.

(21) Appl. No.: 14/455,349

(22) Filed: Aug. 8, 2014

(65) Prior Publication Data

US 2015/0049073 A1 Feb. 19, 2015

(30) Foreign Application Priority Data

Aug. 13, 2013 (JP) ..... 2013-168319
Aug. 17, 2013 (JP) ..... 2013-169296

(51) Int. Cl.
*G09G 3/36* (2006.01)

(52) U.S. Cl.
CPC ..... *G09G 3/3688* (2013.01); *G09G 3/3614* (2013.01); *G09G 2310/027* (2013.01); *G09G 2310/0297* (2013.01); *G09G 2320/0204* (2013.01); *G09G 2320/0252* (2013.01)

(58) Field of Classification Search
CPC ..... G09G 2310/027; G09G 2310/0297; G09G 2320/0204; G09G 2320/0252; G09G 3/3614; G09G 3/3688
See application file for complete search history.

(56) References Cited

U.S. PATENT DOCUMENTS

2003/0179170 A1* 9/2003 Lee ..... G09G 3/3648 345/87
2004/0140985 A1* 7/2004 Liaw ..... G09G 3/3696 345/690
2004/0257313 A1 12/2004 Kawashima et al.
2005/0168416 A1* 8/2005 Hashimoto ..... G09G 3/3233 345/76
2009/0002358 A1 1/2009 Tamura
2009/0079685 A1* 3/2009 Sakai ..... G09G 3/3648 345/94
2011/0128277 A1 6/2011 Murakami

FOREIGN PATENT DOCUMENTS

JP 2004-318153 A 11/2004
JP 2009-009018 A 1/2009
JP A-2011-172203 9/2011

* cited by examiner

*Primary Examiner* — Ram Mistry
(74) *Attorney, Agent, or Firm* — Oliff PLC

(57) ABSTRACT

In a data line driver, successively input image data are sequentially stored in a first data storage unit and a second data storage unit. A subtracter calculates a difference value between the image data stored in the first data storage unit and the image data stored in the second data storage unit. A timing pulse generator generates a timing pulse based on the calculated difference value, and a charge supply circuit supplies a charge to a gradation voltage output terminal in accordance with the timing pulse. The rising and falling characteristics of gradation voltage when the image data is changed are improved in this way.

16 Claims, 9 Drawing Sheets

DATA LINE DRIVER, SEMICONDUCTOR INTEGRATED CIRCUIT DEVICE, AND ELECTRONIC APPLIANCE WITH IMPROVED GRADATION VOLTAGE

BACKGROUND

1. Technical Field

The present invention relates to a data line driver that drives data lines of a display panel such as a liquid crystal display (LCD) panel. Furthermore, the invention relates to a semiconductor integrated circuit device incorporating such a data line driver, an electronic appliance that uses a display panel driving circuit including such a data line driver, and the like.

2. Related Art

For example, an LCD panel that uses high-temperature poly-silicon (HTPS) thin film transistors (TFTs) are required to have multi-gradation (high definition) and drive data lines at an ultra-high speed. Particularly when one line's worth of pixels in the LCD panel are sequentially driven by a limited number of gradation voltage generating circuits included in a data line driver, it is necessary to cause gradation voltage output from a gradation voltage generating circuit to rise and fall in a short time in response to a change in image data.

To this end, conventionally, an operational amplifier for use in a gradation voltage generating circuit is configured to increase stationary current flowing the differential stage or increase the ability of the output transistor so as to increase the ability of the operational amplifier. However, increasing the stationary current in the differential stage and the output stage leads to an increase in power consumption.

Another method is also conceivable in which a highly accurate amplifier that determines the final gradation voltage and a high drive amplifier that quickly changes gradation voltage upon a change in the level of gradation are connected in parallel so as to drive the data lines at a high speed. This method, however, is problematic in that the high drive amplifier has a high level of driving ability and thus often oscillates due to load.

JP-A-2011-172203, which is an example of related art, discloses an operational amplifier capable of achieving a high slew rate without increasing stationary driving current, and a liquid crystal driving apparatus that uses the operational amplifier. The operational amplifier includes at least one differential input unit that generates a voltage signal corresponding to the potential difference between a non-inverting input signal and an inverting input signal by using a differential pair composed of a pair of transistors, an output unit that generates an output signal having a logic level corresponding to the voltage signal generated by the differential input unit and outputs the output signal, at least one auxiliary current generating unit that detects a rapid change in the non-inverting input signal or the inverting input signal and generates auxiliary current, and a driving current generating unit that generates driving current for driving the differential input unit by summing a predetermined reference current and the auxiliary current.

However, with the operational amplifier disclosed in JP-A-2011-172203, the driving current for driving the differential input unit is increased to achieve a high slew rate after detection of the rapid change in the non-inverting input signal or the inverting input signal, which causes a time difference between the occurrence of the change in the input signal and achieving the high slew rate, and results in a slow response.

JP-A-2011-172203 is an example of related art (paragraphs [0011] to [0013], FIG. 1).

SUMMARY

In view of the above, an advantage of some aspects of the invention is to provide a data line driver that improves the rising and falling characteristics of gradation voltage when image data is changed, so that the data lines of a display panel can be driven at a high speed.

In order to solve the above-described problems, an aspect of the invention provides a data line driver that drives a data line of a display panel by generating gradation voltage based on image data, the data line driver including: a first data storage unit and a second data storage unit that are connected in series and are configured to sequentially store successively supplied image data; a digital-to-analog converter (DAC) configured to perform digital-to-analog (D/A) conversion on the image data stored in the first data storage unit and output an analog image signal; an amplifier configured to amplify the image signal output from the DAC to generate an output signal, and supply the output signal to a gradation voltage output terminal; a subtracter configured to calculate a difference value between the image data stored in the first data storage unit and the image data stored in the second data storage unit; a timing pulse generator configured to generate a timing pulse based on the difference value calculated by the subtracter; and a charge supply circuit configured to supply a charge to the gradation voltage output terminal in accordance with the timing pulse generated by the timing pulse generator.

According to this aspect of the invention, a difference value between two successive image data is digitally calculated, and the charge supply circuit supplies a charge to the gradation voltage output terminal based on the difference value, and it is therefore possible to perform a higher speed charge supply operation than the amplifier. Accordingly, it is possible to improve the rising and falling characteristics of gradation voltage when the image data is changed, and drive the data lines of a display panel at a high speed. On the other hand, the amplifier can maintain accurate gradation voltage based on the analog image signal obtained by D/A conversion of the image data.

Here, the data line driver may further include an action table storage unit configured to store therein an action table and output pulse width data corresponding to the difference value calculated by the subtracter, the action table being a table in which pulse width data indicating pulse widths of the timing pulse are set in correspondence with a plurality of the difference values, and the timing pulse generator may be configured to generate the timing pulse having a pulse width set based on the pulse width data output from the action table storage unit. With this configuration, the timing pulse generator can generate a timing pulse having a pulse width corresponding to the difference value calculated by the subtracter.

In this case, the charge supply circuit may include a plurality of P channel transistors that are connected in parallel between a high potential-side power supply potential and the gradation voltage output terminal and a plurality of N channel transistors that are connected in parallel between the gradation voltage output terminal and a low potential-side power supply potential, and the data line driver may further include: a second action table storage unit configured to store therein a second action table and output a signal indicating selection information corresponding to the difference value calculated by the subtracter, the second action table being a table in which the selection information regarding transistors selected when the charge supply circuit is operated are set in correspondence with a plurality of the difference values; and a transistor driving circuit configured to turn on at least one transistor selected by the signal output from the second action table storage unit in accordance with the timing pulse generated by the timing pulse generator. With this configuration, because at least one transistor having an appropriate driving ability is selected, it is possible to compensate for insufficient accuracy of the pulse width of the timing pulse.

Also, the data line driver may further include: a third action table storage unit configured to store therein a third action table and output a signal indicating selection information corresponding to the image data stored in the first data storage unit, the third action table being a table in which selection information regarding transistors additionally selected when the charge supply circuit is operated are set in correspondence with a plurality of image data values; and an additional transistor driving circuit configured to, upon selection of at least one transistor by the signal output from the third action table storage unit, turn on the at least one transistor in accordance with the timing pulse generated by the timing pulse generator. With this configuration, it is possible to compensate for insufficient driving ability of the transistor when the source-drain voltage of the transistor is small.

Alternatively, the data line driver may further include a pulse width setting unit configured to set a pulse width of the timing pulse based on the difference value calculated by the subtracter, and the timing pulse generator may generate the timing pulse having the pulse width set by the pulse width setting unit. With this configuration, the timing pulse generator can generate a timing pulse having a pulse width corresponding to the difference value calculated by the subtracter.

In this case, the charge supply circuit may include a plurality of P channel transistors that are connected in parallel between a high potential-side power supply potential and the gradation voltage output terminal and a plurality of N channel transistors that are connected in parallel between the gradation voltage output terminal and a low potential-side power supply potential, and the data line driver may further include: a transistor setting unit configured to output a signal indicating selection information regarding a transistor selected when the charge supply circuit is operated based on the difference value calculated by the subtracter; and a transistor driving circuit configured to turn on at least one transistor selected by the signal output from the transistor setting unit in accordance with the timing pulse generated by the timing pulse generator. With this configuration, because at least one transistor having an appropriate driving ability is selected, it is possible to compensate for insufficient accuracy of the pulse width of the timing pulse.

Also, the data line driver may further include: an additional transistor setting unit configured to output a signal indicating selection information regarding a transistor additionally selected when the charge supply circuit is operated based on the image data stored in the first data storage unit; and an additional transistor driving circuit configured to, upon selection of at least one transistor by the signal output from the additional transistor setting unit, turn on the at least one transistor in accordance with the timing pulse generated by the timing pulse generator. With this configuration, it is possible to compensate for insufficient driving ability of the transistor when the source-drain voltage of the transistor is small.

Alternatively, the charge supply circuit may include: a polar pulse output unit configured to output a polar pulse having a polarity corresponding to positive or negative of the difference value calculated by the subtracter in accordance with the timing pulse generated by the timing pulse generator; a differentiator circuit configured to differentiate the polar pulse output from the polar pulse output unit; and a second amplifier configured to amplify the polar pulse differentiated by the differentiator circuit to generate a second output signal, and supply the second output signal to the gradation voltage output terminal. In this case, by combining the output signal of the amplifier that amplifies the image signal and the output signal of the second amplifier that amplifies the differentiated polar pulse, it is possible to improve the rising and falling characteristics of gradation voltage when the image data is changed, and drive the data lines of a display panel at a high speed.

The above-described data line driver may further include a switch circuit configured to open and close a connection between an output terminal of the amplifier and the gradation voltage output terminal. With this configuration, it is possible to separate the output terminal of the amplifier from the gradation voltage output terminal during operation of the charge supply circuit, and reduce the influence of the amplifier on the operation of the charge supply circuit.

In this case, the data line driver may further include a control circuit configured to turn off the switch circuit in synchronization with a timing when the image data stored in the first and second data storage units are changed, and turn on the switch circuit after operation of the charge supply circuit. With this configuration, when the image data is changed, the charge supply circuit supplies a charge to the gradation voltage output terminal so as to improve the rising and falling characteristics of the gradation voltage, thereafter, the amplifier finely adjusts the gradation voltage, and thus accurate gradation voltage can be maintained.

A semiconductor integrated circuit device according to an aspect of the invention includes any one of the above-described data line drivers. With this configuration, a circuit including the data line driver can be reduced in size, and thus the circuit can be disposed in a vicinity of a display panel.

An electronic appliance according to an aspect of the invention includes: (i) a display panel; and a display panel driving circuit that includes (ii) any one of the above-described data line drivers and drives the display panel. It is thereby possible to provide an electronic appliance including a display panel whose data lines are driven at a high speed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
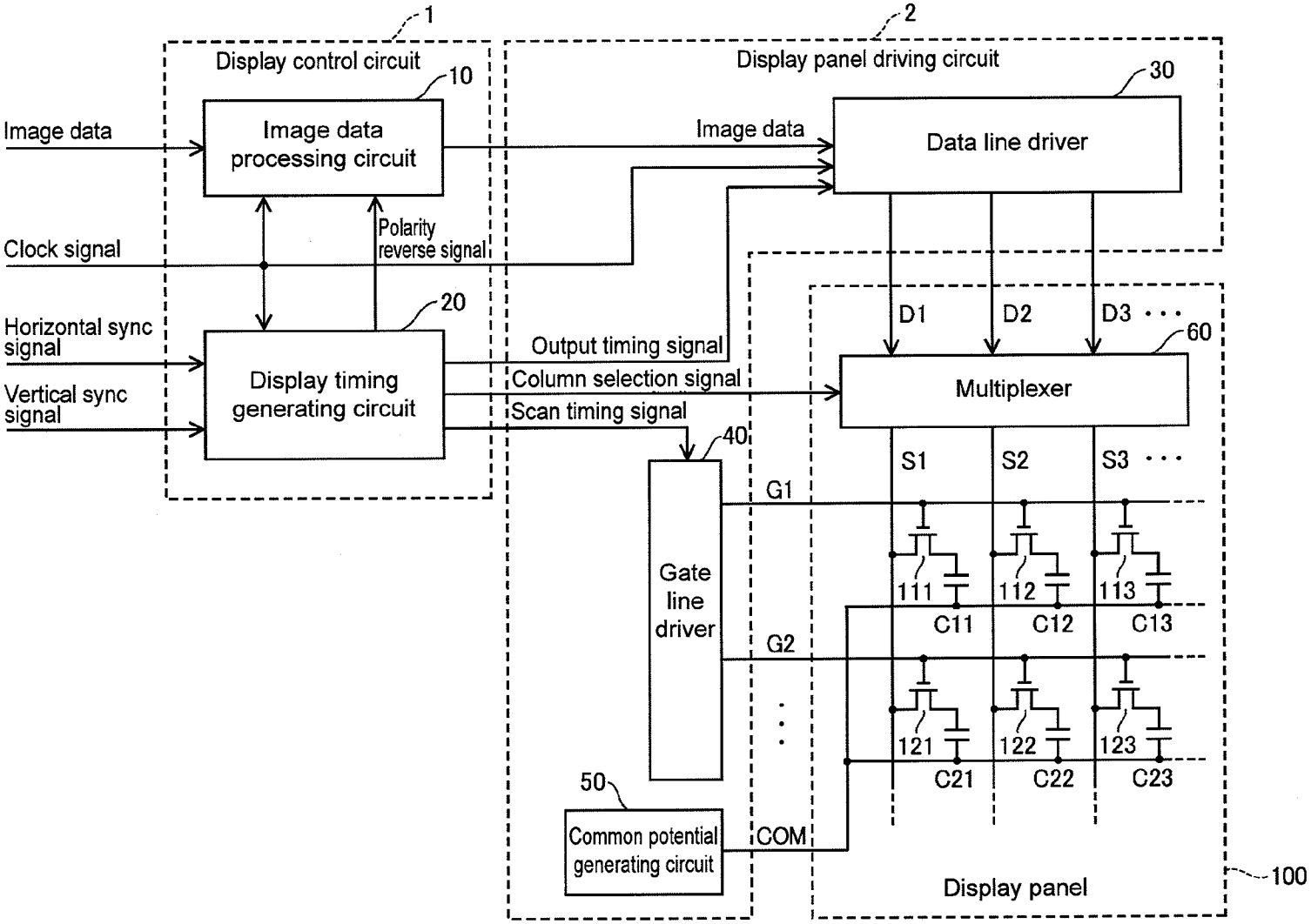
FIG. 1 is a diagram showing an image display unit including a data line driver according to an embodiment of the invention.

Hereinafter, embodiments of the invention will be described in detail with reference to the drawings. The same reference numerals are given to the same constituent elements, and an overlapping description will be omitted.

FIG. 1 is a block diagram showing an exemplary configuration of an image display unit including a data line driver according to an embodiment of the invention. As shown in FIG. 1, the image display unit includes a display control circuit 1, a display panel driving circuit 2, and a display panel 100, and is configured to display an image based on image data or the like supplied from the outside.

The display panel 100 may be a color display panel having red (R) pixels, green (G) pixels and blue (B) pixels, or may be a monochrome display panel having single-color pixels. Particularly for use as a video projector, three different display panels may be provided in order to form red (R), green (G) and blue (B) images. In this case, three different data line drivers may be provided so as to correspond to the three different display panels.

Also, the display panel 100 may be an LCD panel, or may be an organic electro-luminescence (EL) panel, for example. The present embodiment will be described taking, as an example, an active matrix transmissive LCD panel.

An active matrix LCD panel includes a first transparent substrate having a plurality of discrete electrodes and a plurality of thin film transistors (TFTs) connected to the plurality of discrete electrodes, a second transparent substrate having one common electrode and being disposed in opposed relation to the first transparent substrate, and a liquid crystal sealed between the first transparent substrate and the second transparent substrate.

In the display panel 100, for example, a number of discrete electrodes corresponding to the number of pixels of, for example, 720×132 are arranged in a two-dimensional matrix. In FIG. 1, capacitances formed between the discrete electrodes and the common electrode are represented by C11, C12, C13, . . . , C21, C22, C23, . . . . Also, a number of TFTs corresponding to the number of pixels and represented by 111, 112, 113, . . . , 121, 122, 123, . . . are arranged in a two-dimensional matrix.

Drains of the plurality of TFTs are connected respectively to the plurality of discrete electrodes. As shown in FIG. 1, sources of the TFTs arranged in a plurality of vertical columns are connected respectively to source lines S1, S2, S3, . . . . Furthermore, as shown in FIG. 1, gates of the TFTs arranged in a plurality of horizontal lines (rows) are connected respectively to gate lines (also referred to as "scan lines") G1, G2, . . . . Each TFT outputs, from its drain, gradation voltage that is supplied to its source so as to apply the voltage to the corresponding discrete electrode, when the TFT is turned on by application of a high-level scan signal to its gate.

In the display panel 100, continuous application of DC voltage across the discrete electrodes and the common electrode causes degradation in characteristics of the liquid crystal. Accordingly, the polarity of voltage applied between the discrete electrodes and the common electrode is reversed at a predetermined cycle. In the present embodiment, a frame reverse method in which the polarity of applied voltage is reversed for each frame, or a line reverse method in which the polarity of applied voltage is reversed for each line is used.

The display control circuit 1 includes an image data processing circuit 10 and a display timing generating circuit 20. The display panel driving circuit 2 includes a data line driver 30, a gate line driver 40 and a common potential generating circuit 50.

The data line driver 30 may be internally provided in a semiconductor integrated circuit device (display driver IC), alone or together with the gate line driver 40 or the common potential generating circuit 50. With this configuration, a circuit including the data line driver 30 can be reduced in size, and thus the circuit can be disposed in a vicinity of the display panel 100. Also, the display control circuit 1 may be internally provided in a semiconductor integrated circuit device (display controller IC) that is different from the display driver IC, or may be incorporated in the display driver IC.

The image data processing circuit 10 receives input of image data and a clock signal, and performs image processing on the image data as needed. For example, the image data processing circuit 10 processes the image data such that the polarity of gradation voltage is reversed for each frame or for each line in accordance with a polarity reverse signal. To be specific, in the case where the common potential applied to the common electrode is constantly 7 V, the gradation potential applied to the discrete electrodes is reversed between a positive polarity of 12 V and a negative polarity of 2 V when the gradation is 100%. Furthermore, the image data processing circuit 10 may perform ordinary image processing such as contour enhancement.

The display timing generating circuit 20 receives input of a horizontal sync signal, a vertical sync signal and a clock signal, and generates various types of timing signals. Examples of the various types of timing signals include a polarity reverse signal that indicates whether the polarity of gradation voltage is reversed or non-reversed, an output timing single that indicates the timing of output of the gradation voltage, a column selection signal that selects a writing column in the display panel 100, a scan timing signal that indicates the timing of switching of a writing line in the display panel 100, and the like.

The data line driver 30 generates gradation voltage based on the image data supplied from the image data processing circuit 10 in accordance with the clock signal and the output timing signal, and drives the data lines of the display panel 100. The data line driver 30 outputs a plurality of generated gradation voltages respectively to data lines (also referred to as "signal lines") D1, D2, D3, . . . of the display panel 100.

A multiplexer 60 provided in the display panel 100 connects the data lines D1, D2, D3, . . . to a group of source lines selected from the source lines S1, S2, S3, . . . in accordance with the column selection signal. It is thereby possible to sequentially drive one line's worth of pixels of the display panel 100 by a limited number of gradation voltage generating circuits that are included in the data line driver 30. In the case where the data line driver 30 is provided with a number of gradation voltage generating circuits equal to the number of pixels in one line of the display panel 100, it is unnecessary to provide the multiplexer 60, and the number of data lines D1, D2, D3, . . . is equal to the number of source lines S1, S2, S3, . . . .

The gradation voltage supplied to the source line S1 is applied to the sources of the TFTs 111, 121, . . . in the first column. Likewise, the gradation voltage supplied to the source line S2 is applied to the sources of the TFTs 112, 122, . . . in the second column. Furthermore, the gradation voltage supplied to the source line S3 is applied to the TFTs 113, 123, . . . in the third column. The same applies to subsequent columns.

The gate line driver 40 sequentially activates a plurality of scan signals supplied to the gate lines G1, G2, . . . to a high level (for example, 15 V) in accordance with the scan timing signal. Thus, among a plurality of TFTs connected to each source line, a TFT whose gate line has been activated to a high level is turned on to apply the gradation voltage to the discrete electrode connected to the drain of the TFT. The common potential generating circuit 50 generates a common potential COM, and applies the common potential COM to the common electrode of the display panel 100. Through this, an image is displayed on the display panel 100.

A first exemplary configuration of the data line driver shown in FIG. 1 will now be described.

Figure 2:
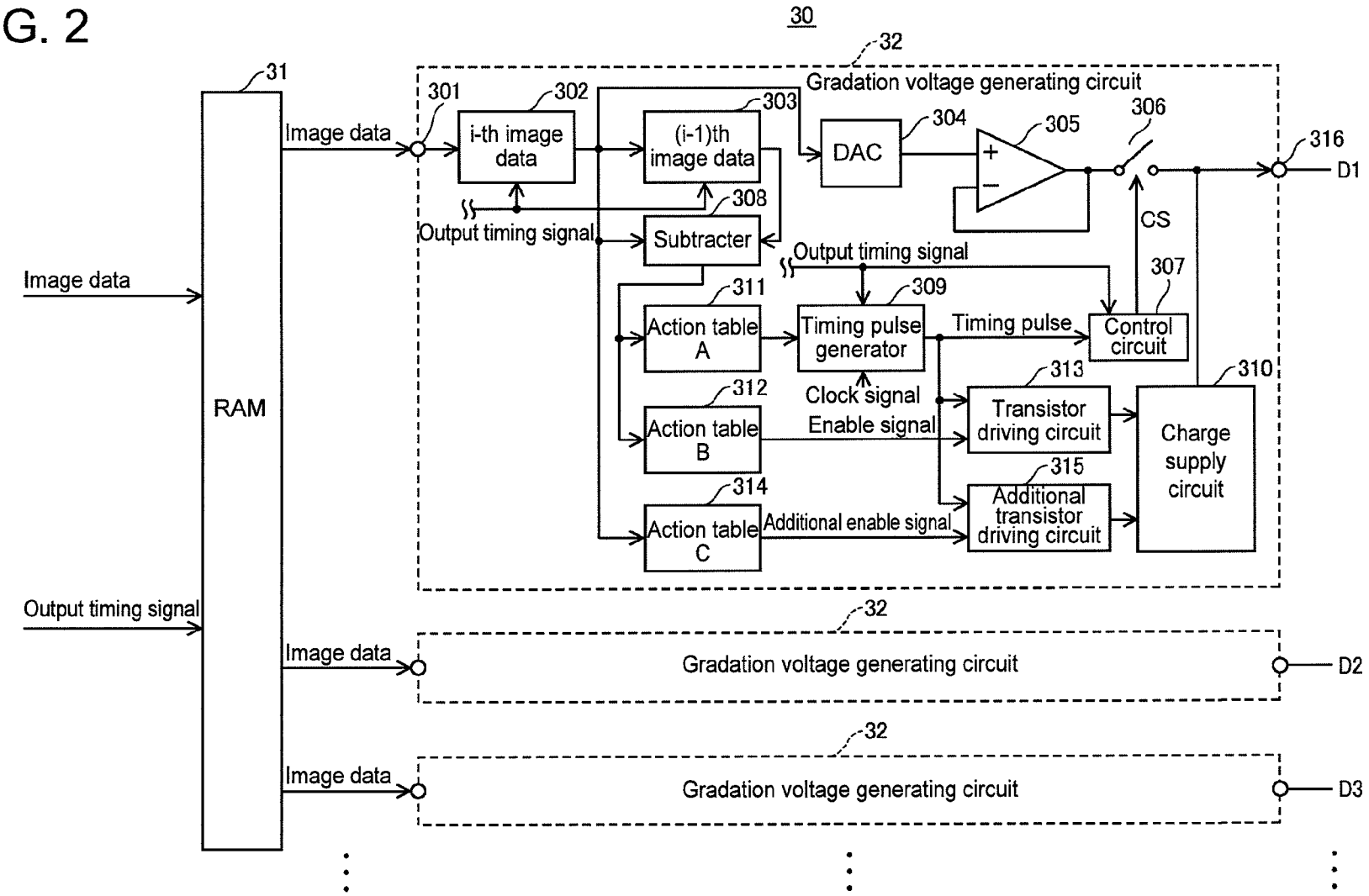
FIG. 2 is a diagram showing a first exemplary configuration of the data line driver shown in FIG. 1.

FIG. 2 is a diagram showing a first exemplary configuration of the data line driver shown in FIG. 1. As shown in FIG. 2, the data line driver 30 includes a random access memory (RAM) 31, and a plurality of gradation voltage generating circuits 32. The RAM 31 temporarily stores therein image data supplied from the image data processing circuit 10 (FIG. 1), and outputs a plurality of pixels' worth of image data in parallel in accordance with the output timing signal.

Each gradation voltage generating circuits 32 includes an image data input terminal 301, data latch circuits (data storage unit) 302 and 303, a digital-to-analog converter (DAC) 304, an amplifier 305, a switch circuit 306, a control circuit 307, a subtracter 308, a timing pulse generator 309, a charge supply circuit 310, and a gradation voltage output terminal 316.

One pixel's worth of image data is supplied to the gradation voltage generating circuit 32 at a time from the RAM 31 in synchronization with the output timing signal. The data latch circuits 302 and 303, which are connected in series, sequentially store image data successively supplied in synchronization with the output timing signal. FIG. 2 shows that the data latch circuit 302 stores i-th image data, and the data latch circuit 303 stores (i−1)th image data.

The DAC 304 performs digital-to-analog (D/A) conversion on the image data stored in the data latch circuit 302, and outputs an analog image signal. In the case where the DAC 304 is a resistor ladder DAC, the DAC conversion characteristics are determined by resistance values set in the ladder resistor circuit. For example, the DAC 304 may perform D/A conversion on the image data according to the conversion characteristics that correct gamma characteristics of the display panel 100 (FIG. 1). Note that, however, in the case where the image data supplied to the RAM 31 has already undergone ordinary gamma correction, it is sufficient that the DAC 304 performs gamma correction on a difference when the gamma characteristics of the display panel 100 is different from the ordinary gamma characteristics.

The amplifier 305 amplifies the image signal output from the DAC 304 so as to generate an output signal, and supplies the output signal to the gradation voltage output terminal 316 via the switch circuit 306. With application of overall negative feedback having a high open loop gain (negative feedback from the output terminal toward the inverting input terminal), the amplifier 305 can amplify the image signal with high accuracy. This, however causes some delay in rising and falling of the output signal. Accordingly, the subtracter 308, the timing pulse generator 309 and the charge supply circuit 310 are provided in order to improve the rising and falling characteristics of gradation voltage when the image data is changed.

The subtracter 308 calculates a difference value between the i-th image data stored in the data latch circuit 302 and the (i−1)th image data stored in the data latch circuit 303. The timing pulse generator 309 generates a timing pulse that operates the charge supply circuit 310 based on the difference value calculated by the subtracter 308. For example, the timing pulse generator 309 may generate a timing pulse having a pulse width that is substantially proportional to the absolute value of the difference value calculated by the subtracter 308.

The charge supply circuit 310 supplies a charge to the gradation voltage output terminal 316 in accordance with the timing pulse generated by the timing pulse generator 309. If the difference value calculated by the subtracter 308 is positive, the charge supply circuit 310 supplies a positive charge to the gradation voltage output terminal 316. If the difference value is negative, the charge supply circuit 310 supplies a negative charge to the gradation voltage output terminal 316.

According to the present embodiment, a difference value between two successive image data is digitally calculated, and the charge supply circuit 310 supplies a charge to the gradation voltage output terminal 316 based on the calculated difference value, and it is therefore possible to perform a higher speed charge supply operation than the amplifier 305. Accordingly, it is possible to improve the rising and falling characteristics of gradation voltage when the image data is changed, and drive the data lines of the display panel 100 at a high speed. On the other hand, the amplifier 305 can maintain accurate gradation voltage based on the analog image signal obtained by D/A conversion of the image data.

In order to generate the timing pulse that operates the charge supply circuit 310, an action table storage unit 311 as shown in FIG. 2 may be provided. The action table storage unit 311 includes, for example, a non-volatile memory or the like, and stores therein an action table A in which pulse width data indicating the pulse widths of timing pulses are set in correspondence with a plurality of difference values (or a plurality of difference value ranges). The action table storage unit 311 refers to the action table A, and thereby outputs pulse width data corresponding to the difference value calculated by the subtracter 308.

The timing pulse generator 309 sets a start timing and an end timing for operating the charge supply circuit 310 based on the pulse width data output from the action table storage unit 311, and thereby generates a timing pulse having a pulse width set based on the pulse width data.

For example, the timing pulse generator 309 may set the start timing by latching the output timing signal in synchronization with the clock signal. Also, the timing pulse generator 309 may set the end timing by delaying the start timing in synchronization with the clock signal in accordance with the pulse width indicated by the pulse width data.

By doing so, the timing pulse generator 309 can generate a timing pulse having a pulse width set based on the difference value calculated by the subtracter 308. However, if the cycle of the clock signal is not so short, the accuracy of the pulse width of the timing pulse cannot be made sufficiently high.

To address this, the amount of charge supplied to the gradation voltage output terminal 316 may be controlled with high accuracy by providing a plurality of transistors that are connected in parallel in the charge supply circuit 310, and selecting at least one transistor that is turned on based on the difference value calculated by the subtracter 308. In this case, an action table storage unit 312 and a transistor driving circuit 313 as shown in FIG. 2 are provided.

The action table storage unit 312 includes, for example, a non-volatile memory or the like, and stores therein an action table B in which selection information regarding transistors selected when the charge supply circuit 310 is operated are set in correspondence with a plurality of difference values (or a plurality of difference value ranges). The action table storage unit 312 refers to the action table B, and thereby outputs an enable signal indicating selection information corresponding to the difference value calculated by the subtracter 308.

The transistor driving circuit 313 turns on at least one transistor selected by the enable signal output from the action table storage unit 312 in accordance with the timing pulse generated by the timing pulse generator 309.

With this configuration, because at least one transistor having an appropriate driving ability is selected, it is possible to compensate for insufficient accuracy of the pulse width of the timing pulse. However, depending on the value of gradation voltage that needs to be output, the source-drain voltage of the selected transistor is small, which reduces the driving ability of the transistor.

To address this, the amount of charge supplied to the gradation voltage output terminal 316 may be corrected by providing a plurality of correction transistors in the charge supply circuit 310, and additionally selecting at least one transistor that is turned on based on the value of the i-th image data stored in the data latch circuit 302. In this case, an action table storage unit 314 and an additional transistor driving circuit 315 as shown in FIG. 2 are provided.

The action table storage unit 314 includes, for example, a non-volatile memory or the like, and stores therein an action table C in which selection information regarding transistors additionally selected when the charge supply circuit 310 is operated are set in correspondence with a plurality of image data values (or a plurality of image data value ranges). The action table storage unit 314 refers to the action table C, and thereby outputs an additional enable signal indicating selection information corresponding to the i-th image data stored in the data latch circuit 302.

Upon selection of at least one transistor by the additional enable signal output from the action table storage unit 314, the additional transistor driving circuit 315 turns on the at least one transistor in accordance with the timing pulse generated by the timing pulse generator 309. It is thereby possible to compensate for insufficient driving ability of the transistor when the source-drain voltage of the transistor is small.

Figure 3:
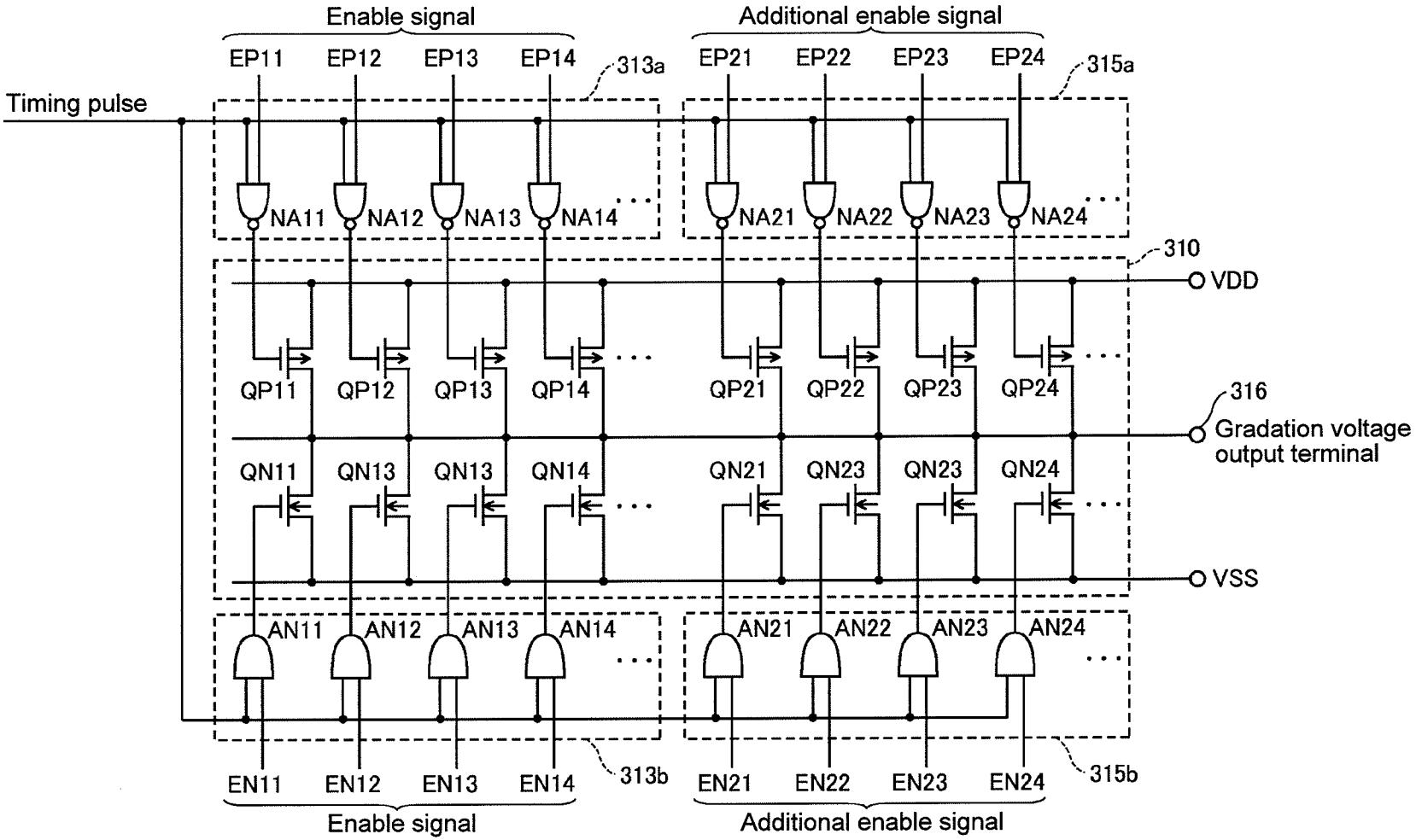
FIG. 3 is a diagram showing an exemplary configuration of the charge supply circuit, the transistor driving circuit, and the like shown in FIG. 2.

FIG. 3 is a diagram showing an exemplary configuration of the charge supply circuit, the transistor driving circuit and the additional transistor driving circuit shown in FIG. 2. As shown in FIG. 3, the charge supply circuit 310 includes a first group of P channel MOS transistors QP11, QP12, . . . and a second group of P channel MOS transistors QP21, QP22, . . . that are connected in parallel between a high potential-side power supply potential VDD and the gradation voltage output terminal 316.

The source of each transistor is connected to an interconnect of the power supply potential VDD, and the drain of each transistor is connected to the gradation voltage output terminal 316. It is desirable that the first group of P channel MOS transistors QP11, QP12, . . . have mutually different sizes (for example, channel widths) such as 1:2: . . . . It is also desirable that the second group of P channel MOS transistors QP21, QP22, . . . have mutually different sizes as described above.

The charge supply circuit 310 also includes a first group of N channel MOS transistors QN11, QN12, . . . and a second group of N channel MOS transistors QN21, QN22, . . . that are connected in parallel between the gradation voltage output terminal 316 and a low potential-side power supply potential VSS.

The drain of each transistor is connected to the gradation voltage output terminal 316, and the source of each transistor is connected to an interconnect of the power supply potential VSS. It is desirable that the first group of N channel MOS transistors QN11, QN12, . . . have mutually different sizes such as 1:2: . . . . It is also desirable that the second group of N channel MOS transistors QN21, QN22, . . . have mutually different sizes as described above.

Transistor driving circuits 313*a* and 313*b* together constitute the transistor driving circuit 313 shown in FIG. 2. The transistor driving circuit 313*a* includes a plurality of logic circuits that AND the timing pulse and enable signals EP11, EP12, . . . , and output low-level driving pulses. The output signals of the logic circuits are respectively applied to the gates of the first group of P channel MOS transistors QP11, QP12, . . . in the charge supply circuit 310.

FIG. 3 shows NAND circuits NA11, NA12, . . . as an example of the plurality of logic circuits of the transistor driving circuit 313*a*. Upon supply of a high-level timing pulse having a set pulse width while, for example, the enable signal EP11 is activated to a high level, the NAND circuit NA11 outputs a low-level driving pulse having the same pulse width as the timing pulse. Upon application of the driving pulse to a gate of the transistor QP11, the transistor QP11 is turned on, and supplies a positive charge from the power supply potential VDD to the gradation voltage output terminal 316.

The transistor driving circuit 313*b* includes a plurality of logic circuits that AND the timing pulse and enable signals EN11, EN12, . . . , and output high-level driving pulses. The output signals of the logic circuits are respectively applied to the gates of the first group of N channel MOS transistors QN11, QN12, . . . in the charge supply circuit 310.

FIG. 3 shows AND circuits AN11, AN12, . . . as an example of the plurality of logic circuits of the transistor driving circuit 313*b*. Upon supply of a high-level timing pulse having a set pulse width while, for example, the enable signal EN11 is activated to a high level, the AND circuit AN11 outputs a high-level driving pulse having the same pulse width as the timing pulse. Upon application of the driving pulse to a gate of the transistor QN11, the transistor QN11 is turned on, and supplies a negative charge from the power supply potential VSS to the gradation voltage output terminal 316.

Additional transistor driving circuits 315*a* and 315*b* together constitute the additional transistor driving circuit 315 shown in FIG. 2. The additional transistor driving circuit 315*a* includes a plurality of logic circuits that AND the timing pulse and additional enable signals EP21, EP22, . . . , and output low-level driving pulses. The output signals of the logic circuits are respectively applied to the gates of the second group of P channel MOS transistors QP21, QP22, . . . in the charge supply circuit 310.

FIG. 3 shows NAND circuits NA21, NA22, . . . as an example of the plurality of logic circuits of the additional transistor driving circuit 315*a*. Upon supply of a high-level timing pulse having a set pulse width while, for example, the additional enable signal EP21 is activated to a high level, the NAND circuit NA21 outputs a low-level driving pulse having the same pulse width as the timing pulse. Upon application of the driving pulse to a gate of the transistor QP21, the transistor QP21 is turned on, and supplies a positive charge from the power supply potential VDD to the gradation voltage output terminal 316.

The additional transistor driving circuit 315*b* includes a plurality of logic circuits that AND the timing pulse and additional enable signals EN21, EN22, . . . , and output high-level driving pulses. The output signals of the logic circuits are respectively applied to the gates of the second group of N channel MOS transistors QN21, QN22, . . . in the charge supply circuit 310.

FIG. 3 shows AND circuits AN21, AN22, . . . as an example of the plurality of logic circuits of the additional transistor driving circuit 315*b*. Upon supply of a high-level timing pulse having a set pulse width while, for example, the additional enable signal EN21 is activated to a high level, the AND circuit AN21 outputs a high-level driving pulse having the same pulse width as the timing pulse. Upon application of the driving pulse to a gate of the transistor QN21, the transistor QN21 is turned on, and supplies a negative charge from the power supply potential VSS to the gradation voltage output terminal 316.

Referring again to FIG. 2, the switch circuit 306 opens and closes the connection between the output terminal of the amplifier 305 and the gradation voltage output terminal 316. This enables the output terminal of the amplifier 305 to be separated from the gradation voltage output terminal 316 during operation of the charge supply circuit 310, and thus the influence of the amplifier 305 on the operation of the charge supply circuit 310 can be reduced. The opening and closing of the switch circuit 306 is controlled by a control signal CS output from the control circuit 307.

The control circuit 307 turns off the switch circuit 306 in synchronization with a timing when the image data stored in the data latch circuits 302 and 303 are changed, in accordance with the output timing signal. Also, the control circuit 307 turns on the switch circuit 306 in accordance with the timing pulse generated by the timing pulse generator 309 after operation of the charge supply circuit 310. By doing so, when the image data is changed, the charge supply circuit 310 supplies a charge to the gradation voltage output terminal 316 so as to improve the rising and falling characteristics of the gradation voltage, thereafter, the amplifier 305 finely adjusts the gradation voltage, and thus accurate gradation voltage can be maintained.

Figure 4A:
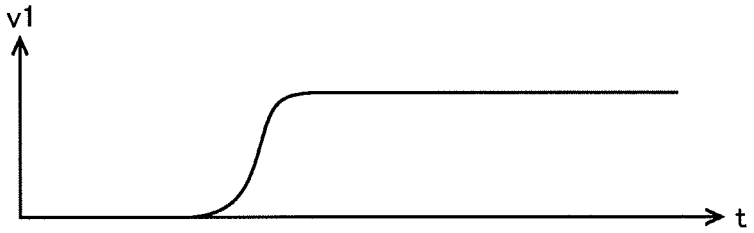
FIG. 4A, FIG. 4B and FIG. 4C (collectively "FIG. 4") are diagrams showing synthesis of a gradation voltage waveform by the amplifier and the charge supply circuit shown in FIG. 2.
Figure 4B:
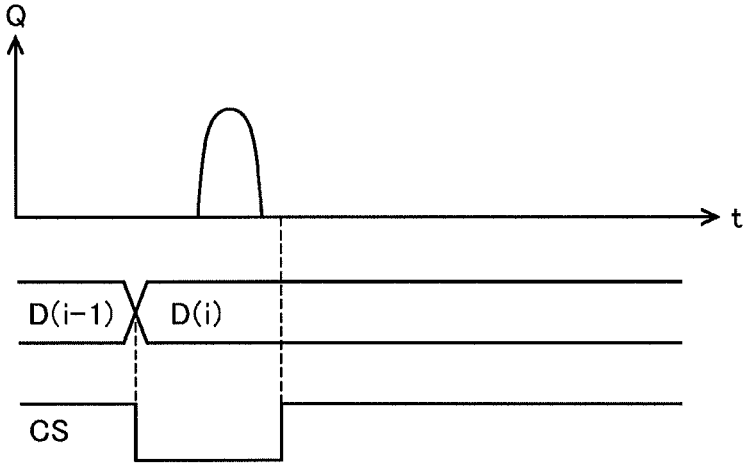

FIG. 4 is a diagram showing synthesis of a gradation voltage waveform by the amplifier and the charge supply circuit shown in FIG. 2. As shown in FIG. 4A, an output signal v1 of the amplifier 305 that has received input of the image signal has a slow rising edge, but after that, maintains accurate voltage due to negative feedback. On the other hand, as shown in FIG. 4B, a charge Q supplied by the charge supply circuit 310 has a pulse waveform corresponding to a change in the image signal.

As shown in FIG. 4B, the control signal CS output from the control circuit 307 is deactivated to a low level in synchronization with a timing when the image data stored in the data latch circuit 302 is changed from D(i−1) to D(i), and the switch circuit 306 is thereby turned off. While the switch circuit 306 is off, the output terminal of the amplifier 305 is separated from the gradation voltage output terminal 316. After that, the charge supply circuit 310 supplies the charge Q to the gradation voltage output terminal 316.

The capacitances formed between the discrete electrodes and the common electrode of the display panel and interconnect capacitances serve as a load to the charge supply circuit 310. The charge supply circuit 310 supplies the charge Q to the capacitances, and thereafter, due to high output impedance, there is little influence on the gradation voltage. When the charge supply operation of the charge supply circuit 310 ends, the control signal CS is activated to a high level, and the switch circuit 306 is thereby turned on. While the switch circuit 306 is on, the output terminal of the amplifier 305 is connected to the gradation voltage output terminal 316.

Figure 4C:
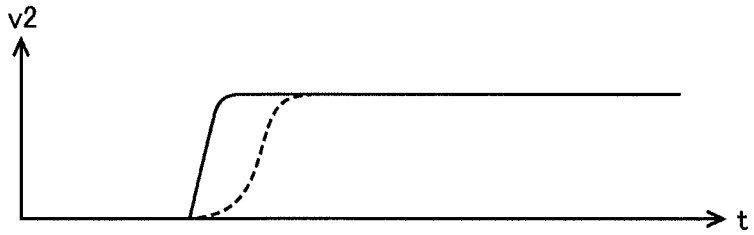

By synthesizing the output signal v1 of the amplifier 305 and the charge Q supplied by the charge supply circuit 310, a gradation voltage v2 having a waveform shown in FIG. 4C is obtained. In the waveform (indicated by a solid line) of the gradation voltage v2, the rising characteristics are improved as compared to the waveform (indicated by a broken line) of the output signal v1 of the amplifier 305. The waveform of the gradation voltage v2 can be optimized by adjusting the pulse width data, the selection information and the like set in the action tables A to C.

Next is a description of a second exemplary configuration of the data line driver shown in FIG. 1.

Figure 5:
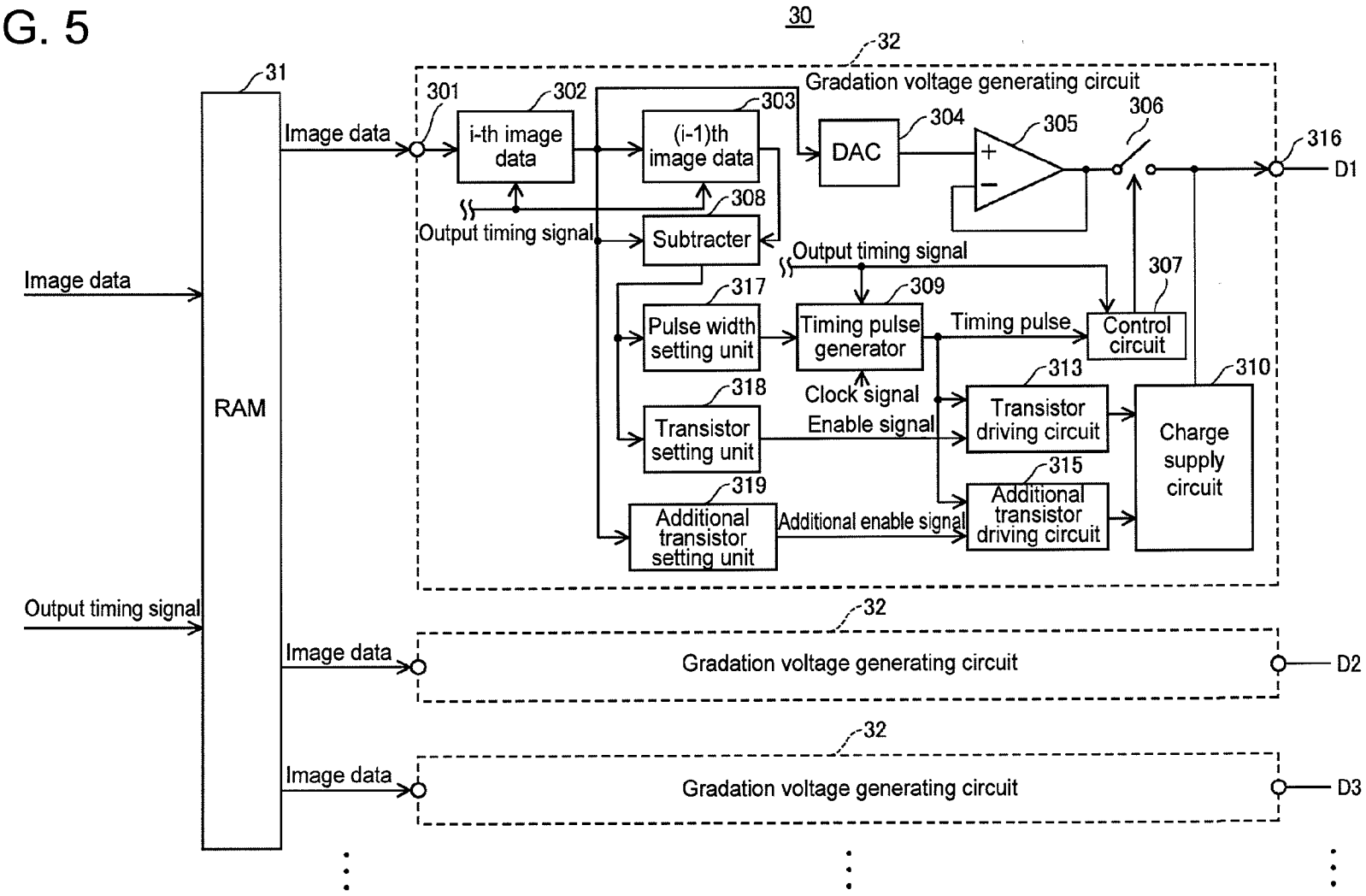
FIG. 5 is a diagram showing a second exemplary configuration of the data line driver shown in FIG. 1.

FIG. 5 is a diagram showing a second exemplary configuration of the data line driver shown in FIG. 1. In the second exemplary configuration shown in FIG. 5, a pulse width setting unit 317, a transistor setting unit 318 and an additional transistor setting unit 319 are provided in place of the action table storage units 311, 312 and 314 shown in the first exemplary configuration in FIG. 2. The second exemplary configuration is the same as first exemplary configuration except for the above difference.

The pulse width setting unit 317 is constituted by, for example, a logic circuit, and sets the pulse width of the timing pulse based on the difference value calculated by the subtracter 308. For example, the pulse width setting unit 317 may set a pulse width that is substantially proportional to the absolute value of the difference value calculated by the subtracter 308, and output pulse width data indicating the pulse width.

The timing pulse generator 309 generates a timing pulse having the pulse width set by the pulse width setting unit 317. For example, the timing pulse generator 309 may set a start timing and an end timing for operating the charge supply circuit 310 based on the pulse width data output from the pulse width setting unit 317, and generate a timing pulse having the pulse width determined by the start timing and the end timing.

In this case, the timing pulse generator 309 may set the start timing by latching the output timing signal in synchronization with the clock signal. Also, the timing pulse generator 309 may set the end timing by delaying the start timing in synchronization with the clock signal in accordance with the pulse width indicated by the pulse width data.

By doing so, the timing pulse generator 309 can generate a timing pulse having the pulse width set based on the difference value calculated by the subtracter 308. However, if the cycle of the clock signal is not so short, the accuracy of the pulse width of the timing pulse cannot be made sufficiently high.

To address this, the amount of charge supplied to the gradation voltage output terminal 316 may be controlled with high accuracy by providing a plurality of transistors that are connected in parallel in the charge supply circuit 310, and selecting at least one transistor that is turned on based on the difference value calculated by the subtracter 308. In this case, a transistor setting unit 318 and a transistor driving circuit 313 shown in FIG. 5 are provided.

The transistor setting unit 318 is constituted by, for example, a logic circuit, and outputs an enable signal indicating selection information regarding a transistor selected when the charge supply circuit 310 is operated based on the difference value calculated by the subtracter 308.

The transistor driving circuit 313 turns on at least one transistor selected by the enable signal output from the transistor setting unit 318 in accordance with the timing pulse generated by the timing pulse generator 309.

With this configuration, because at least one transistor having an appropriate driving ability is selected, it is possible to compensate for insufficient accuracy of the pulse width of the timing pulse. However, depending on the value of gradation voltage that needs to be output, the source-drain voltage of the transistor in the charge supply circuit 310 is small, which reduces the driving ability of the transistor.

To address this, the amount of charge supplied to the gradation voltage output terminal 316 may be corrected by providing a plurality of correction transistors in the charge supply circuit 310, and additionally selecting at least one transistor that is turned on based on the value of the i-th image data stored in the data latch circuit 302. In this case, an additional transistor setting unit 319 and an additional transistor driving circuit 315 as shown in FIG. 5 are provided.

The additional transistor setting unit 319 is constituted by, for example a logic circuit, and outputs an additional enable signal that represents selection information regarding an additionally selected transistor used when the charge supply circuit 310 is operated based on the i-th image data stored in the data latch circuit 302.

Upon selection of at least one transistor by the additional enable signal output from the additional transistor setting unit 319, the additional transistor driving circuit 315 turns on the at least one transistor in accordance with the timing pulse generated by the timing pulse generator 309. It is thereby possible to compensate for insufficient driving ability of the transistor when the source-drain voltage of the transistor is small.

Next is a description of a third exemplary configuration of the data line driver shown in FIG. 1.

Figure 6:
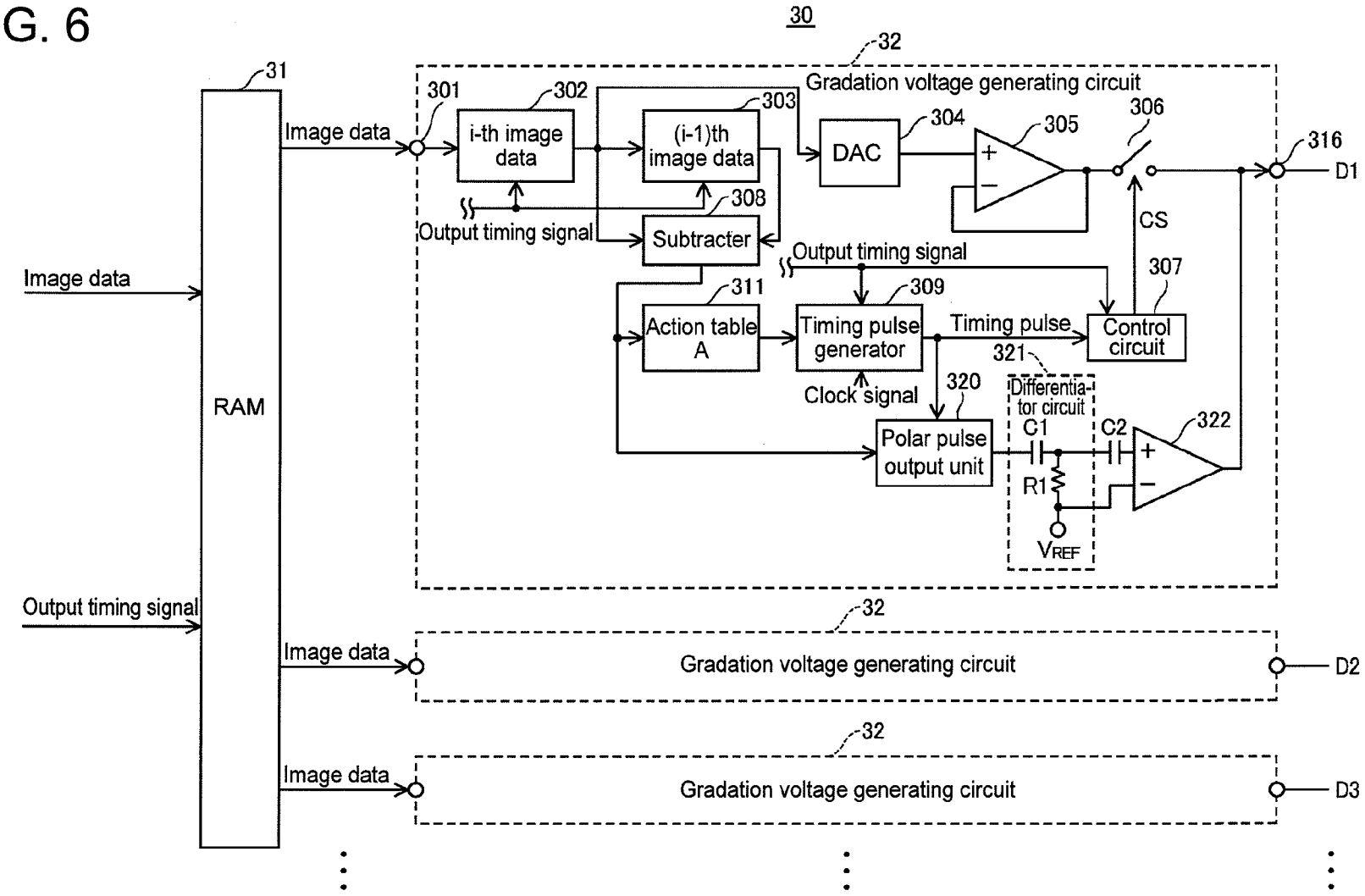
FIG. 6 is a diagram showing a third exemplary configuration of the data line driver shown in FIG. 1.

FIG. 6 is a diagram showing a third exemplary configuration of the data line driver shown in FIG. 1. In the third exemplary configuration shown in FIG. 6, a polar pulse output unit 320, a differentiator circuit 321 and an amplifier 322 are provided in place of the action table storage units 312 and 314, the transistor driving circuit 313 and the additional transistor driving circuit 315 shown in the first exemplary configuration in FIG. 2. The third exemplary configuration is the same as the first exemplary configuration except for the above difference. It is also possible to provide the pulse width setting unit 317 shown in the second exemplary configuration in FIG. 5 in place of the action table storage unit 311.

The polar pulse output unit 320, the differentiator circuit 321 and the amplifier 322 together constitute a charge supply circuit that supplies a charge to the gradation voltage output terminal 316 in accordance with the timing pulse generated by the timing pulse generator 309. The polar pulse output unit 320 outputs a polar pulse having a polarity corresponding to the positive or negative of the difference value calculated by the subtracter 308 in accordance with the timing pulse generated by the timing pulse generator 309.

For example, the polar pulse output unit 320 includes a P channel MOS transistor connected between the high potential-side power supply potential VDD and the output terminal, an N channel MOS transistor connected between the output terminal and the low potential-side power supply potential VSS, and a logic circuit for driving the transistors.

The logic circuit applies a low-level driving pulse having the same pulse width as the timing pulse generated by the timing pulse generator 309 to a gate of the P channel MOS transistor if the difference value calculated by the subtracter 308 is positive. Accordingly, a positive polar pulse is output from the output terminal.

If, on the other hand, the difference value calculated by the subtracter 308 is negative, the logic circuit applies a high-level driving pulse having the same pulse width as the timing pulse generated by the timing pulse generator 309 to a gate of the N channel MOS transistor. Accordingly, a negative polar pulse is output from the output terminal.

The differentiator circuit 321 includes a capacitor C1 and a resistor R1. A first terminal of the capacitor C1 is connected to the output terminal of the polar pulse output unit 320, and a second terminal of the capacitor C1 is connected to a first terminal of the resistor R1. A reference potential $V_{REF}$ that is supplied to a reverse input terminal of the amplifier 322 and serves as a reference for amplification operation is supplied to a second terminal of the resistor R1. A coupling capacitor C2 is connected between the second terminal of the capacitor C1 and a non-inverting input terminal of the amplifier 322.

The differentiator circuit 321 differentiates the polar pulse output from the polar pulse output unit 320. The amplifier 322 is an operational amplifier having a high driving ability, and amplifies the polar pulse differentiated by the differentiator circuit 321 so as to generate an output signal and supplies the output signal to the gradation voltage output terminal 316. The output signal of the amplifier 305 and the output signal of the amplifier 322 are thereby combined by the gradation voltage output terminal 316 to generate a gradation voltage.

With the configuration described above, the output signal of the amplifier 305 that amplifies the image signal and the output signal of the amplifier 322 that amplifies the differentiated polar pulse are combined, and it is thus possible to improve the rising and falling characteristics of gradation voltage when the image data is changed, and drive the data lines of the display panel 100 (FIG. 1) at a high speed.

The amplifier 305 DC amplifies the image signal output from the DAC 304, with overall negative feedback. With application of overall negative feedback having a high open loop gain, the amplifier 305 can amplify the image signal with high accuracy. On the other hand, the amplifier 322 AC amplifies the polar pulse differentiated by the differentiator circuit 321 without overall negative feedback. Without application of overall negative feedback to the amplifier 322, it makes it difficult for ringing and the like to occur, and makes the output impedance high. Accordingly, the influence of the amplifier 305 on the operation is reduced.

Figure 7:
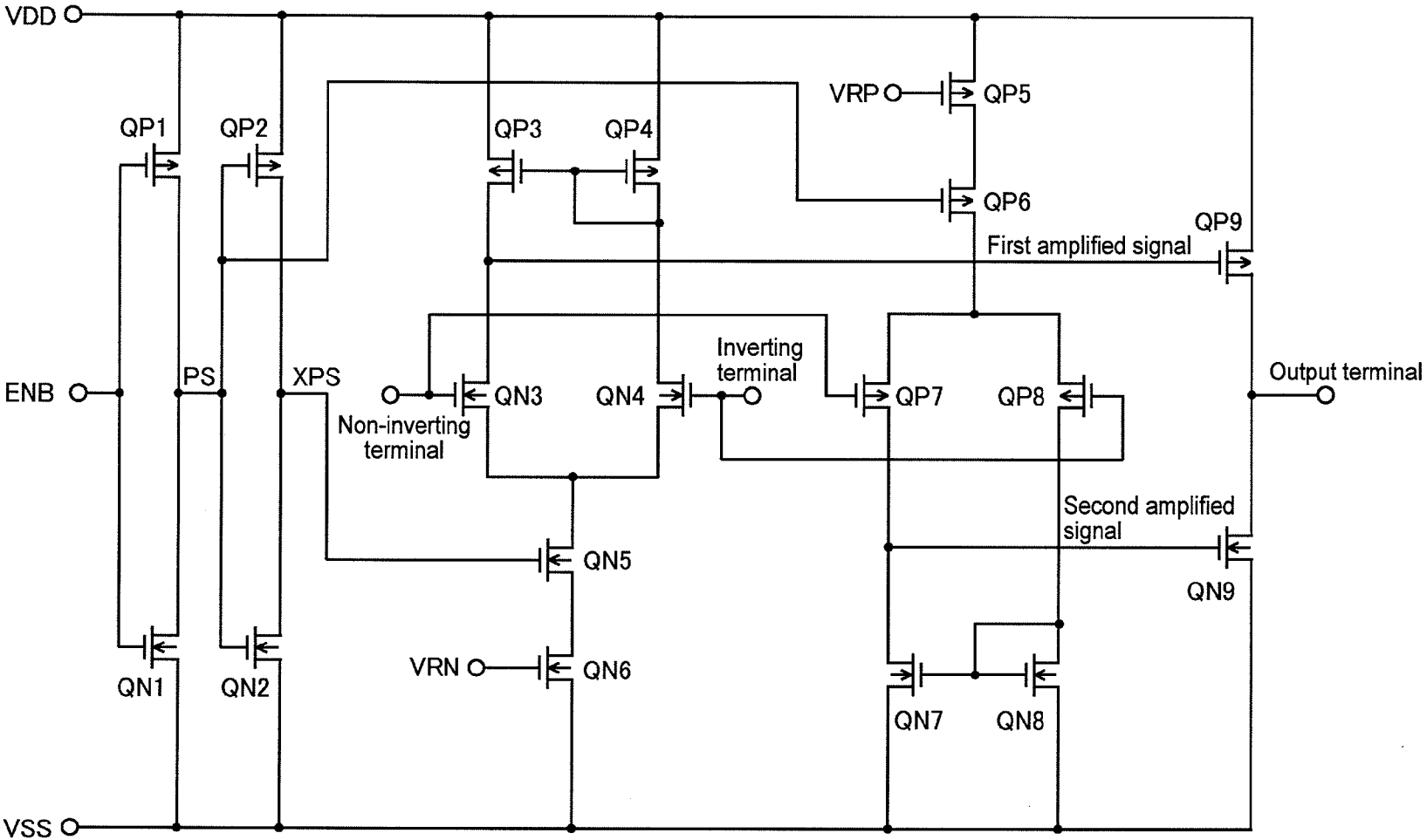
FIG. 7 is a circuit diagram showing an exemplary configuration of an operational amplifier that can be used as any one of the amplifiers shown in FIG. 6.

FIG. 7 is a circuit diagram showing an exemplary configuration of an operational amplifier that can be used as any one of the amplifiers shown in FIG. 6. In FIG. 7, a P channel MOS transistor QP1 and an N channel MOS transistor QN1 together constitute a first inverter. A source of the transistor QP1 is connected to the interconnect of the high potential-side power supply potential VDD. A drain of the transistor QN1 is connected to a drain of the transistor QP1, and a source of the transistor QN1 is connected to the interconnect of the low potential-side power supply potential VSS. Gates of the transistors QP1 and QN1 are connected to an enable signal ENB input terminal. The first inverter reverses the input enable signal ENB and outputs a first control signal PS.

A P channel MOS transistor QP2 and an N channel MOS transistor QN2 together constitute a second inverter. A source of the transistor QP2 is connected to the interconnect of the power supply potential VDD. A drain of the transistor QN2 is connected to a drain of the transistor QP2, and a source of the transistor QN2 is connected to the interconnect of the power supply potential VSS. The first control signal PS is input into gates of the transistors QP2 and QN2. The second inverter reverses the input first control signal PS and outputs a second control signal XPS.

P channel MOS transistors QP3 and QP4, and N channel MOS transistors QN3 to QN6 together constitute a first differential stage. Sources of the transistors QP3 and QP4 are connected to the interconnect of the power supply potential VDD, and gates of the transistors QP3 and QP4 are connected to a drain of the transistor QP4.

A drain of the transistor QN3 is connected to a drain of the transistor QP3, and a gate of the transistor QN3 is connected to a non-reverse input terminal of the operational amplifier. A drain of the transistor QN4 is connected to the drain of the transistor QP4, and a gate of the transistor QN4 is connected to a reverse input terminal of the operational amplifier.

A drain of the transistor QN5 is connected to sources of the transistors QN3 and QN4, and the second control signal XPS is supplied to a gate of the transistor QN5. A drain of the transistor QN6 is connected to the source of the transistor QN5, and a source of the transistor QN6 is connected to the interconnect of the power supply potential VSS. A first bias potential VRN is supplied to a gate of the transistor QN6.

When the enable signal ENB is activated to a high level, the second control signal XPS is also at a high level. Accordingly, the transistor QN5 is turned on to cause the first differential stage to operate. The first differential stage reverses and amplifies a difference between the signal input into the non-reverse input terminal of the operational amplifier and the signal input into the reverse input terminal of the operational amplifier, so as to generate a first amplified signal at the drains of the transistors QP3 and QN3.

P channel MOS transistors QP5 to QP8 and N channel MOS transistors QN7 and QN8 together constitute a second differential stage. A source of the transistor QP5 is connected to the interconnect of the power supply potential VDD, and a second bias potential VRP is supplied to a gate of the transistor QP5. A source of the transistor QP6 is connected to a drain of the transistor QP5, and the first control signal PS is supplied to a gate of the transistor QP6.

Sources of the transistors QP7 and QP8 are connected to a drain of the transistor QP6. A gate of the transistor QP7 is connected to the non-reverse input terminal of the operational amplifier. A gate of the transistor QP8 is connected to the reverse input terminal of the operational amplifier.

A drain of the transistor QN7 is connected to a drain of the transistor QP7, and a source of the transistor QN7 is connected to the interconnect of the power supply potential VSS. A drain of the transistor QN8 is connected to a drain of the transistor QP8, and a source of the transistor QN8 is connected to the interconnect of the power supply potential VSS. Gates of the transistors QN7 and QN8 are connected to the drain of the transistor QN8.

When the enable signal ENB is activated to a high level, the first control signal PS is at a low level. Accordingly, the transistor QP6 is turned on to operate the second differential stage. The second differential stage reverses and amplifies a difference between the signal input into the non-reverse input terminal of the operational amplifier and the signal input into the reverse input terminal of the operational amplifier, so as to generate a second amplified signal at the drains of the transistors QP7 and QN7.

A P channel MOS transistor QP9 and an N channel MOS transistor QN9 together constitute an output stage. A source of the transistor QP9 is connected to the power supply potential VDD, a drain of the transistor QP9 is connected to the output terminal, and the first amplified signal is supplied to a gate of the transistor QP9. A source of the transistor QN9 is connected to the power supply potential VSS, a drain of the transistor QN9 is connected to the output terminal, and the second amplified signal is supplied to a gate of the transistor QN9. The transistor QP9 reverses and amplifies the first amplified signal applied to its gate so as to supply the resulting signal to the output terminal, and the transistor QN9 reverses and amplifies the second amplified signal applied to its gate so as to supply the resulting signal to the output terminal.

In the case where the operational amplifier shown in FIG. 7 is used as the amplifier 322 shown in FIG. 6, in the transistors QN3 and QN4 constituting a differential pair in the first differential stage, the ratio (W/L) between channel width W and channel length L of the transistor QN3 may be set to be smaller than the ratio (W/L) between channel width W and channel length L of the transistor QN4 by a predetermined proportion. In this case, the balance point in the first differential stage shifts, and thus the output transistor QP9 is not turned on unless the potential of the non-reverse input terminal becomes higher than the potential of the reverse input terminal by a certain degree.

Also, in the transistors QP7 and QP8 constituting a differential pair in the second differential stage, the ratio (W/L) between channel width W and channel length L of the transistor QP7 may be set to be smaller than the ratio (W/L) between channel width W and channel length L of the transistor QP8 by a predetermined proportion. In this case, the balance point in the second differential stage shifts, and thus the output transistor QN9 is not turned on unless the potential of the non-reverse input terminal becomes lower than the potential of the reverse input terminal by a certain degree.

As a result, if the potential of the non-reverse input terminal is within a predetermined range of the potential of the reverse input terminal, the operational amplifier does not perform an amplification operation, and the output impedance of the operational amplifier increases. That is, this operational amplifier has a deadband with respect to a predetermined range of input voltage.

Accordingly, the amplifier 322 performs operation when there is a significant change in the level of the polar pulse output from the polar pulse output unit 320, but does not perform operation when the change in the level of the polar pulse is small. It is therefore possible to further reduce the influence on the operation of the amplifier 305 to converge the gradation voltage. It is also possible to further reduce power loss when the output terminal of the amplifier 305 and the output terminal of the amplifier 322 are connected.

The operational amplifier shown in FIG. 7 can also be used as the amplifier 305 shown in FIGS. 2, 5 and 6. However, it is desirable that the slew rate of the amplifier 322 is set to be higher than the slew rate of the amplifier 305. In this case, the effect of improving the gradation voltage waveform exhibited by the amplifier 322 increases.

Also, it is desirable that the size (for example, channel width) and/or driving current of the output transistor of the amplifier 322 is set to be larger than the size and/or driving current of the output transistor of the amplifier 305. In this case, the amplifier 322 can drive the data lines with a high driving ability.

Next is a description of an electronic appliance according to an embodiment of the invention.

The invention is applicable to an electronic appliance such as a video projector, an electronic viewfinder, a display apparatus, or a mobile phone, but hereinafter, an embodiment will be described in which the invention is applied to a video projector.

Figure 8:
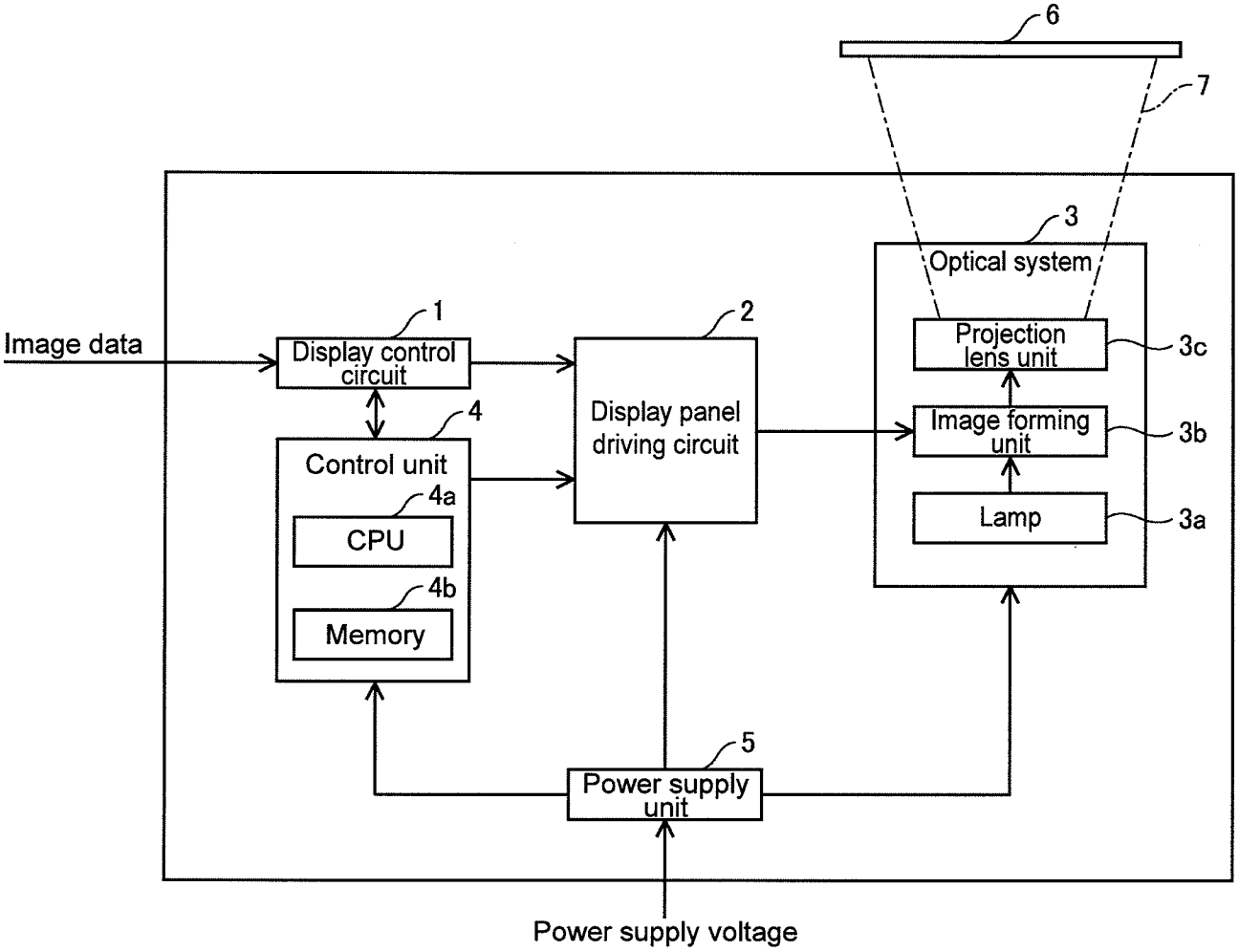
FIG. 8 is a block diagram showing a primary configuration of a video projector.

FIG. 8 is a block diagram showing a primary configuration of a video projector as an electronic appliance according to an embodiment of the invention. As shown in FIG. 8, the video projector includes a display control circuit 1, a display panel driving circuit 2, an optical system 3, a control unit 4 and a power supply unit 5. The video projector can project an image corresponding to image data input from an external apparatus onto a screen 6 or the like.

The display control circuit 1 and the display panel driving circuit 2 are the same as those that have already been described above. The optical system 3 includes a lamp 3*a*, an image forming unit 3*b* and a projection lens unit 3*c*. The lamp 3*a* can be, for example, a high-pressure mercury lamp or a metal hydride lamp, and generates light that is ejected toward the screen 6 via the image forming unit 3*b* and the projection lens unit 3*c*.

The image forming unit 3*b* includes at least one display panel. In the case of a color display, the image forming unit 3*b* may include three display panels. The display panel is a transmissive image forming panel, which forms an image by changing the transmittance of each pixel in accordance with a gradation voltage, a scan signal and the like supplied from the display panel driving circuit 2.

The image forming unit 3*b* is irradiated with the light generated by the lamp 3*a*, and thus the image formed on the display panel is projected onto the projection lens unit 3*c*. The projection lens unit 3*c* refracts incident light and ejects projection light 7. Accordingly, the image formed on the display panel is enlarged and projected onto the screen 6.

The control unit 4 is, for example, a micro-computer, and includes a CPU (central processing unit) 4*a* and a memory 4*b*. The CPU 4*a* controls operations of the display control circuit 1, the display panel driving circuit 2 and the like in accordance with a control program stored in the memory 4*b*. The power supply unit 5 supplies power to each unit of the video projector based on an externally supplied alternating current or direct current power supply voltage.

An exemplary configuration of the image forming unit of the optical system shown in FIG. 8 will now be described in detail.

Figure 9:
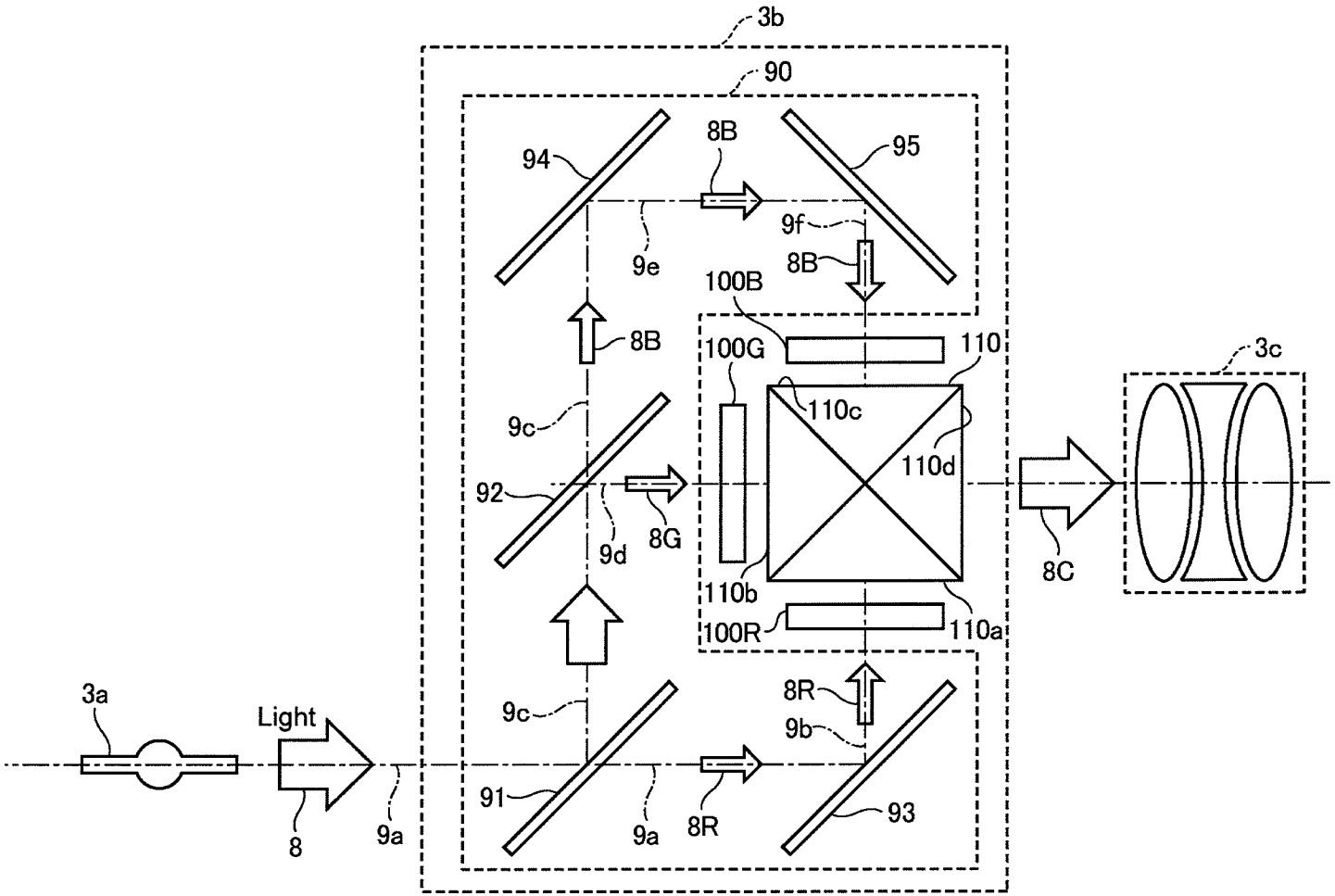
FIG. 9 is a schematic diagram showing an exemplary configuration of the optical system shown in FIG. 8.

FIG. 9 is a schematic diagram showing an exemplary configuration of the optical system shown in FIG. 8. As shown in FIG. 9, the image forming unit 3*b* includes a light splitting unit 90, three display panels 100R, 100G and 100B, and a cross dichroic prism 110.

The light splitting unit 90 includes dichroic mirrors 91 and 92, and reflecting mirrors 93 to 95. Light 8 generated by the lamp 3*a* enters the light splitting unit 90 along an optical axis 9*a*. The light splitting unit 90 splits the incident light (substantially white light) 8 into, for example, red light 8R, green light 8G and blue light 8B.

The dichroic mirror 91 is disposed at an angle of substantially 45° with respect to the optical axis 9*a* at a position intersecting with the optical axis 9*a*. The dichroic mirror 91 allows the red light 8R among the incident light 8 to pass therethrough and reflects the green light 8G and the blue light 8B. The light 8R that has passed through the dichroic mirror 91 is guided to the reflecting mirror 93 along the optical axis 9*a*. The reflecting mirror 93 is disposed at angle of substantially 45° with respect to the optical axis 9*a* at a position intersecting with the optical axis 9*a*. The light 8R is reflected by the reflecting mirror 93 and enters the display panel 100R along an optical axis 9*b*.

On the other hand, the light reflected by the dichroic mirror 91 is guided to the dichroic mirror 92 along an optical axis 9*c*. The dichroic mirror 92 is disposed at an angle of substantially 45° with respect to the optical axis 9*c* at a position intersecting with the optical axis 9*c*. The dichroic mirror 92 reflects the green light 8G among the light reflected by the dichroic mirror 91, and allows the blue light 8B to pass therethrough. The light 8G reflected by the dichroic mirror 92 enters the display panel 100G along an optical axis 9*d*.

On the other hand, the light 8B that has passed through the dichroic mirror 92 is guided to the reflecting mirror 94 along the optical axis 9*c*. The reflecting mirror 94 is disposed at an angle of substantially 45° with respect to the optical axis 9*c* at a position intersecting with the optical axis 9*c*. The light 8B is reflected by the reflecting mirror 94 and guided to the reflecting mirror 95 along an optical axis 9*e*. The reflecting mirror 95 is disposed at an angle of substantially 45° with respect to the direction of the optical axis 9*e* at a position intersecting with the optical axis 9*e*. The light 8B is reflected by the reflecting mirror 95, and enters the display panel 100B along an optical axis 9*f*.

A polarizing plate (not shown) is provided between the light splitting unit 90 and each display panel. Another polarizing plate (not shown) is also provided between each display panel and the cross dichroic prism 110. The polarizing plates each have a transmission axis, and thus can allow light having a polarization axis in a direction of the transmission axis to transmit. A pair of facing polarizing plates that are disposed in opposed relation and sandwich the display panel are provided such that their transmission axes intersect with each other.

The cross dichroic prism 110 is provided at a position corresponding to the point of intersection of the optical axes 9*b*, 9*d* and 9*f*, and has four surfaces 110*a* to 110*d*. The light 8R that has passed through the display panel 100R enters the cross dichroic prism 110 from the surface 110*a*. The light 8G that has passed through the display panel 100G enters the cross dichroic prism 110 from the surface 110*b*. The light 8B that has passed through the display panel 100B enters the cross dichroic prism 110 from the surface 110*c*. Thus, a red image is projected onto the surface 110*a*, a green image is projected onto the surface 110*b*, and a blue image is projected onto the surface 110*c*.

The red light 8R, the green light 8G and the blue light 8B that entered the cross dichroic prism 110 are combined by the cross dichroic prism 110. That is, the red image, the green image and the blue image are combined by the cross dichroic prism 110.

The combined light is output from the surface 110*d* of the cross dichroic prism 110 as color image light 8C, and enters the projection lens unit 3*c*. As shown in FIG. 8, the color image light 8C that has entered the projection lens unit 3*c* is projected onto the screen 6 or the like as the projection light 7. As described above, with the use of a display panel driving circuit including the data line driver according to the invention, it is possible to provide an electronic appliance including a display panel whose data lines are driven at a high speed.

The invention is not limited to the embodiments given above, and various other modifications can be made by those skilled in the art within the technical scope of the invention.

The entire disclosure of Japanese Patent Application No. 2013-169296, filed Aug. 17, 2013 and 2013-168319, filed Aug. 13, 2013 are expressly incorporated by reference herein.

What is claimed is:

1. A data line driver that drives a data line of a display panel by generating gradation voltage based on image data, the data line driver comprising:

a first data storage unit and a second data storage unit that are connected in series and are configured to sequentially store successively supplied image data;

a digital-to-analog converter (DAC) configured to perform digital-to-analog (D/A) conversion on the image data stored in the first data storage unit and output an analog image signal;

an amplifier configured to amplify the image signal output from the DAC to generate an output signal, and supply the output signal to a gradation voltage output terminal;

a subtracter configured to calculate a difference value between the image data stored in the first data storage unit and the image data stored in the second data storage unit;

a timing pulse generator configured to generate a timing pulse based on the difference value calculated by the subtracter;

a charge supply circuit configured to supply a charge to the gradation voltage output terminal in accordance with the timing pulse generated by the timing pulse generator; and an action table storage unit configured to store therein an action table and output pulse width data corresponding to the difference value calculated by the subtracter, the action table being a table in which pulse width data indicating pulse widths of the timing pulse are set in correspondence with a plurality of the difference values, and wherein the timing pulse generator generates the timing pulse having a pulse width set based on the pulse width data output from the action table storage unit, wherein the charge supply circuit includes a plurality of P channel transistors that are connected in parallel between a high potential-side power supply potential and the gradation voltage output terminal and a plurality of N channel transistors that are connected in parallel between the gradation voltage output terminal and a low potential-side power supply potential, and the data line driver further includes:

a second action table storage unit configured to store therein a second action table and output a signal indicating selection information corresponding to the difference value calculated by subtracter, the second action table being a table in which the selection information regarding transistors selected when the charge supply circuit is operated are set in correspondence with a plurality of the difference values; and a transistor driving circuit configured to turn on at least one transistor selected by the signal output from the second action table storage unit in accordance with the timing pulse generated by the timing pulse generator.

2. The data line driver according to claim 1, further comprising:

a third action table storage unit configured to store therein a third action table and output a signal indicating selection information corresponding to the image data stored in the first data storage unit, the third action table being a table in which selection information regarding transistors additionally selected when the charge supply circuit is operated are set in correspondence with a plurality of image data values; and an additional transistor driving circuit configured to, upon selection of at least one transistor by the signal output from the third action table storage unit, turn on the at least one transistor in accordance with the timing pulse generated by the timing pulse generator.

3. A semiconductor integrated circuit device comprising the data line driver according to claim 2.

4. The data line driver according to claim 1, further comprising:

a pulse width setting unit configured to set a pulse width of the timing pulse based on the difference value calculated by the subtracter, wherein the timing pulse generator generates the timing pulse having the pulse width set by the pulse width setting unit.

5. The data line driver according to claim 4, wherein the charge supply circuit includes a plurality of P channel transistors that are connected in parallel between a high potential-side power supply potential and the gradation voltage output terminal and a plurality of N channel transistors that are connected in parallel between the gradation voltage output terminal and a low potential-side power supply potential, and the data line driver further includes:

a transistor setting unit configured to output a signal indicating selection information regarding a transistor selected when the charge supply circuit is operated based on the difference value calculated by the subtracter; and a transistor driving circuit configured to turn on at least one transistor selected by the signal output from the transistor setting unit in accordance with the timing pulse generated by the timing pulse generator.

6. The data line driver according to claim 5, further comprising:

an additional transistor setting unit configured to output a signal indicating selection information regarding a transistor additionally selected when the charge supply circuit is operated based on the image data stored in the first data storage unit; and an additional transistor driving circuit configured to, upon selection of at least one transistor by the signal output from the additional transistor setting unit, turn on the at least one transistor in accordance with the timing pulse generated by the timing pulse generator.

7. A semiconductor integrated circuit device comprising the data line driver according to claim 6.

8. A semiconductor integrated circuit device comprising the data line driver according to claim 5.

9. A semiconductor integrated circuit device comprising the data line driver according to claim 4.

10. The data line driver according to claim 1, wherein the charge supply circuit includes:

a polar pulse output unit configured to output a polar pulse having a polarity corresponding to positive or negative of the difference value calculated by the subtracter in accordance with the timing pulse generated by the timing pulse generator;

a differentiator circuit configured to differentiate the polar pulse output from the polar pulse output unit; and a second amplifier configured to amplify the polar pulse differentiated by the differentiator circuit to generate a second output signal, and supply the second output signal to the gradation voltage output terminal.

11. A semiconductor integrated circuit device comprising the data line driver according to claim 10.

12. The data line driver according to claim 1, further comprising a switch circuit configured to open and close a connection between an output terminal of the amplifier and the gradation voltage output terminal.

13. The data line driver according to claim 12, further comprising a control circuit configured to turn off the switch circuit in synchronization with a timing when the image data stored in the first and second data storage units are changed, and turn on the switch circuit after operation of the charge supply circuit.

14. A semiconductor integrated circuit device comprising the data line driver according to claim 12.

15. A semiconductor integrated circuit device comprising the data line driver according to claim 1.

16. An electronic appliance comprising:

a display panel; and a display panel driving circuit that includes the data line driver according to claim 1 and configured to drive the display panel.

* * * * *